United States Patent [19]

Lavine

[11] 3,977,680

[45] Aug. 31, 1976

[54] BOARD GAME APPARATUS INVOLVING CRIMINAL JUSTICE

[76] Inventor: Matt P. Lavine, 10803 Pleasant Acres Drive, Adelphi, Md. 20783

[22] Filed: Jan. 15, 1976

[21] Appl. No.: 649,398

[52] U.S. Cl. ..... 273/134 C; 273/134 D

[51] Int. Cl.[2] ..... A63F 3/00

[58] Field of Search ..... 273/134

[56] References Cited

UNITED STATES PATENTS

| | | | |
|---|---|---|---|
| 1,695,144 | 12/1928 | Edwards | 273/134 C |
| 2,165,891 | 7/1939 | Freedman | 273/134 C |
| 2,177,078 | 10/1939 | Raizen et al. | 273/134 C |
| 2,211,297 | 8/1940 | Bull | 273/134 C |
| 2,215,352 | 9/1940 | Flory | 273/134 AD |
| 2,239,779 | 4/1941 | Clark et al. | 273/134 AD |
| 3,473,809 | 10/1969 | Day | 273/134 C |
| 3,539,189 | 11/1970 | Shelton | 273/134 AF |
| 3,545,762 | 12/1970 | Atkinson | 273/134 B |
| 3,643,958 | 2/1972 | Sperber | 273/134 AD |
| 3,850,433 | 11/1974 | Purlia | 273/134 AD |
| 3,885,792 | 5/1975 | Breslow | 273/134 C |
| 3,889,955 | 6/1975 | Welch et al. | 273/134 D |
| 3,926,438 | 12/1975 | Breslow et al. | 273/134 C |

FOREIGN PATENTS OR APPLICATIONS

| | | | |
|---|---|---|---|
| 657,563 | 9/1951 | United Kingdom | 273/134 AT |

*Primary Examiner*—Delbert B. Lowe
*Attorney, Agent, or Firm*—Irvin A. Lavine

[57] ABSTRACT

A board game involving the criminal judicial process. The equipment includes a supply of "people cards" each exhibiting a person having individual socio-economic characteristics. From this supply each player selects one card at random to establish his "identity" for the course of the game. A game board is provided with a branching and recombining path providing for analogies to such events as posting/not posting bond, public or private attorney, etc. A first card and a chance device combine to establish the "Alleged Crime" of each player and a second card and said chance device to select the type of Defense Attorney. At the "jury selection" spaces on the board, a jury of nine is selected by choice from a group of 15 randomly chosen people cards. The characteristics of the jury are numerically weighted to provide a realistic simulation of jury selection as related to the accused and the Alleged Crime. The player may gain or lose advantage points during his movement along the path on the game board between arraignment and verdict, which are computed to establish the verdict of guilty or not guilty.

4 Claims, 8 Drawing Figures

| SUBSET | JURY SELECTION POINT CARD | |
|---|---|---|
| A | IF CRIME IS ODD NUMBER (ACCORDING TO FIG. 3) | GIVE 3 PTS. FOR EACH SINGLE WOMAN<br>GIVE 2 PTS. FOR SUBSET D<br>SUBTRACT 2 PTS. FOR ALL OTHER |
| | IF CRIME IS EVEN NUMBER (ACCORDING TO FIG. 3) | GIVE 3 PTS. FOR SUBSET D<br>GIVE 2 PTS. FOR SUBSET C<br>SUBTRACT 3 PTS. FOR A & B SUBSET |
| B | FOR CRIMES NUMBER 1 & 2 | GIVE 3 PTS. FOR SUBSET B<br>SUBTRACT 1 PT. ALL OTHER SUBSETS |
| | FOR OTHERS | GIVE 2 PTS. FOR SUBSET C<br>GIVE 1 PT. FOR SUBSET D<br>SUBTRACT 3 PTS. FOR SUBSETS B & A |
| C | GIVE 2 PTS. FOR SUBSET A<br>GIVE 1 PT. FOR SUBSET B<br>SUBTRACT 2 PTS. FOR SUBSET C<br>SUBTRACT 1 PT. FOR SUBSET D | |
| D | FOR CRIME 4 & 5 | GIVE 3 PTS. FOR SUBSET D<br>GIVE 1 PT. FOR SUBSET A<br>SUBTRACT 1 PT. FOR SUBSET B<br>SUBTRACT 3 PTS. FOR SUBSET C |
| | FOR ALL OTHER CRIMES | GIVE 2 PTS. FOR SUBSET A<br>GIVE 1 PT. FOR SUBSET B<br>SUBTRACT 3 PTS. FOR SUBSET C<br>SUBTRACT 1 PT. FOR SUBSET D |

FIG. 6

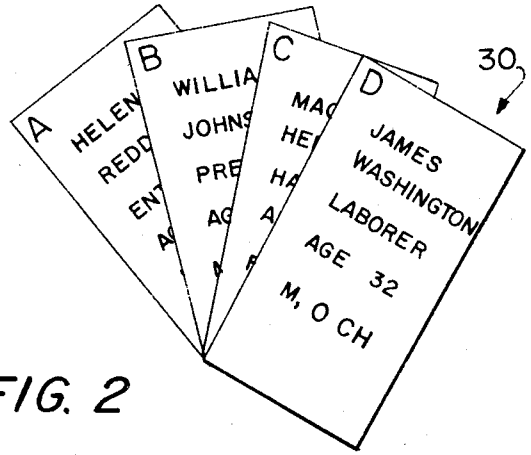

FIG. 2

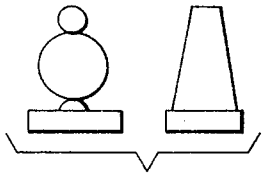

FIG. 7

FIG. 8

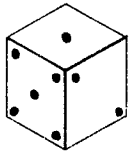

| ATTY. SELECTION CARD | | | | | | |
|---|---|---|---|---|---|---|
| | NUMBER ROLLED | | | | | |
| | 1 | 2 | 3 | 4 | 5 | 6 |
| C | Pvt. | P.D. | P.D. | P.D. | P.D. | P.D. |
| D | P.D. | P.D. | Pvt. | P.D. | P.D. | P.D. |

FIG. 4

| | NUMBER ROLLED ON DIE | | | | | |
|---|---|---|---|---|---|---|
| | 1 | 2 | 3 | 4 | 5 | 6 |
| A | MURDER | EMBEZZLE MENT | * RAPE | EMBEZZLE MENT | MURDER | GRAND LARCENY |
| B | MURDER | MURDER | FORGERY | FORGERY | EMBEZZLE MENT | GRAND LARCENY |
| C | ARMED ROBBERY | KIDNAPPING | ARMED ROBBERY | ARMED ROBBERY & MURDER | ARMED ROBBERY | MURDER |
| D | * RAPE | * RAPE | MURDER | ARMED ROBBERY | ARMED ROBBERY | MURDER |

* ROLL AGAIN IF FEMALE

FIG. 3

| BOND – POSTING CARD | | | | | | |
|---|---|---|---|---|---|---|
| | NUMBER ROLLED | | | | | |
| | 1 | 2 | 3 | 4 | 5 | 6 |
| C | YES | YES | YES | YES | NO | YES |
| D | YES | YES | YES | NO | NO | YES |

FIG. 5

BOARD GAME APPARATUS INVOLVING CRIMINAL JUSTICE

BACKGROUND OF THE INVENTION

This invention relates to an educational game which simulates the criminal justice procedure, from the initial police encounter, through Attorney selection, arraignment, the posting of bond and the selection of an appropriate jury.

The right to a fair trial has been recognized for several hundred years as being a keystone of the American Governmental system. Provisions for a fair trial were set forth in the Constitution, and the right of the citizenry has been expanded over the years by numerous decisions of the Courts. A large number of American citizens, however, have little actual information relative to a fair trial, and the requirements of it, other than that gained by attention to such entertainment media as book, moving pictures and television. However, these treatments are, in general, intended more for entertainment than for instruction. Consequently, a better understanding of the actual proceedings through which a criminal defendant must pass, and in particular the relationship of a choice of jurors to the defendent's chances of acquittal have received little, if any, attention, in those media which are intended for the general public.

PURPOSE OF THE INVENTION

The primary purpose of the present invention is to provide a challenging and entertaining game, which will impart, in addition, educative values relative to the criminal judicial process in the United States.

Another object of the present invention is to emphasize the different events which are experienced by defendants in criminal judicial proceedings having different socio-economic backgrounds or characteristics.

It is a further object and purpose of the present invention to provide an education in connection with the steps in the typical criminal judicial process, and including emphasis in particular on the importance of the jury selection step in the trial of a criminal case in the highly diversified society present in many communities throughout the United States at this time.

Still another object and purpose of the present invention apparatus is to introduce into such a game an appreciation of the part that chance will always play in a criminal trial, no matter how strongly all of the participants in the trial including Judges, Attorneys and Jurors would desire to eliminate chance from being a factor in the outcome of the trial.

SUMMARY OF THE INVENTION

The present invention board game apparatus is provided to achieve the above stated purposes and objects, among others. There is provided a game board which has a plurality of spaces connected together in adjacent manner, so as to form a generally elongate path, but with certain auxiliary looping paths. One alternate or auxiliary looping path is provided for players who cannot post bond, and another, designated a "jail path", is provided for those who are guilty. Certain spaces on the board are provided with indicia which award to the player whose marker lands thereon a "point" while other spaces are provided with indicia which withdraw a point from the player whose marker lands thereon. Other spaces on the game board path provide such instructions as "obtain Counsel" and Jury selection, so that players must stop at those spaces and proceed as indicated. Each player, during the course of the game, is provided with a particular identity, arrived at by chance, by selecting a card from a set of people cards. The people cards each has the name, sex and age of the individual, together with information relating to the socio-economic characteristics of the individual, such as occupation, marital status, etc. Preferably, there are a number of sub-sets or groupings of the people cards, so as to provide plural groups of socio-economic characteristics. Each player, once charged with his crime, chooses a jury of, for example, nine members, from fifteen randomly selected people cards, the group of fifteen thereby constituting the veniremen. A crime card is provided, which assigns to the player a crime with which he is charged, determined by the roll of a die. Once charged with a crime, Counsel must be obtained, and for the more affluent, a private practice Attorney is automatically assigned, whereas for those players whose identity is of a person having lower socio-economic characteristics, an Attorney selector card is provided, giving such identified players a minor chance only of obtaining a private practice Attorney, there being otherwise provided a public defender Attorney. The lower socio-economic identity players are also confronted with the problem of posting bond, with a penalty of proceeding through an extraneous loop path on the game board if a roll of the die and a "bond posting card" determine that a player cannot post bond.

In addition, a jury selector card is provided, which is viewed only when the player reaches the space on the board marked "verdict". This jury selection card provides or removes points from the score of the player, depending upon the relationship between the indentity of the player, the crime with which the player is charged, and the identity of the nine jurors selected. Thus, by selecting a favorable jury from the veniremen provided, a player may acquire points, and may either acquire or lose points during his travel along the path on the game board. A determination of guilty is made for those who have a minus score, and such judgement requires that player to move in a circuitous path known as the jail path. A positive point score at the verdict square permits the player to be judged "not guilty" and to then proceed to the terminal space, the first player to arrive at the terminal space winning the game the others placing in accordance with the order of their arrival at the terminal space.

BRIEF DESCRIPTION OF THE DRAWINGS

FIG. 2 is a view of a plurality of people cards, illustrating one card from each sub-set.

FIG. 3 shows the crime selector card.

FIG. 4 shows the Attorney selector card.

FIG. 5 is the bond-posting card.

FIG. 6 is the jury selection point card.

FIG. 7 illustrates game pieces.

FIG. 8 shows a conventional die.

DESCRIPTION OF THE PREFERRED EMBODIMENT

Figure 1:
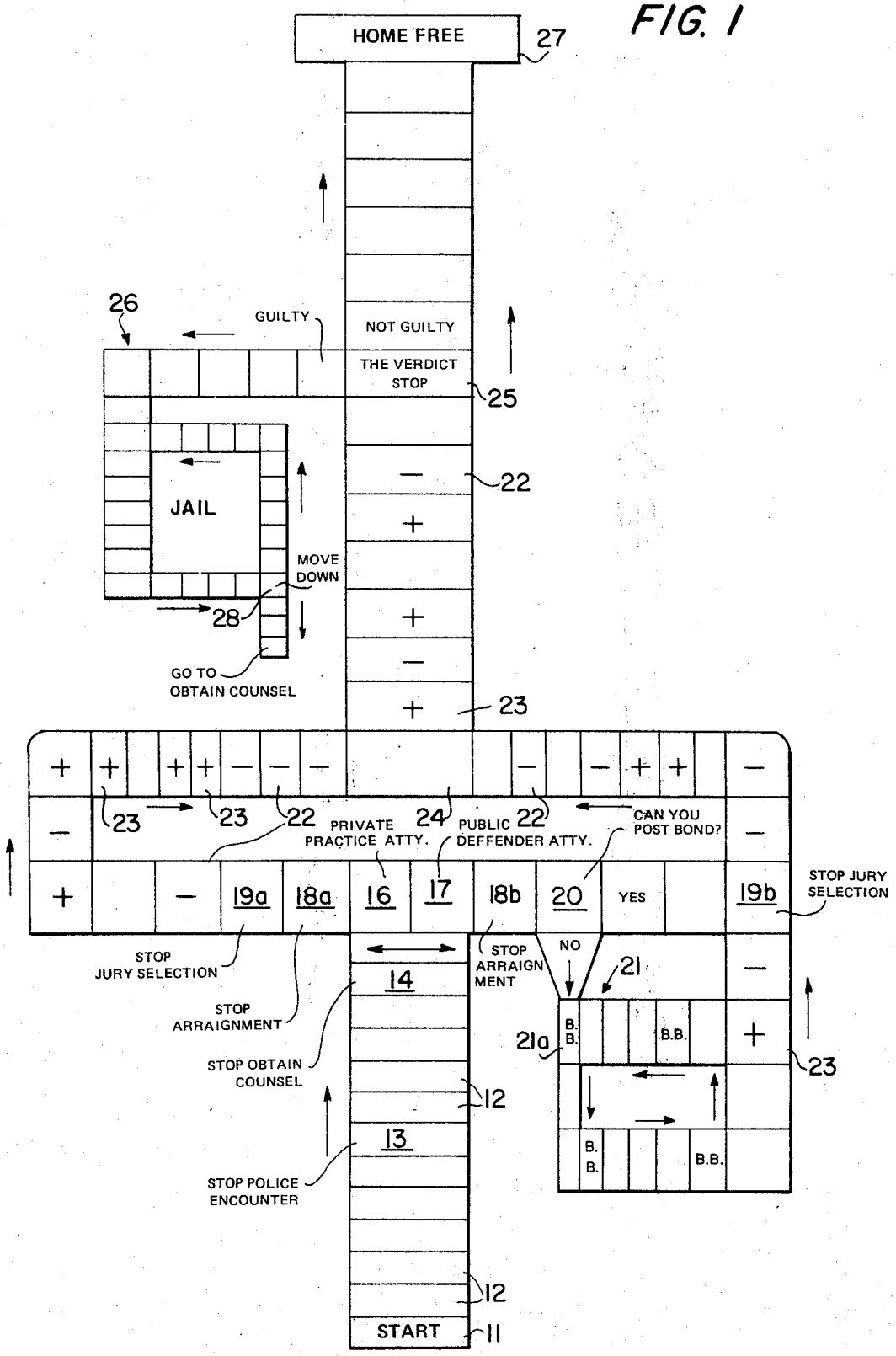
FIG. 1 is a view showing a game board in accordance with the present invention.

Referring now to the drawings, wherein like or corresponding reference numerals are given to like or corresponding elements, features and parts throughout the several views, there is shown in FIG. 1 a game board provided with a plurality of spaces. These include a start space 11, and a suitable number of intermediate spaces 12. Space 13 is the Police Encounter space, and space 14 is designated Obtain Counsel. The path defined by the spaces then divides, there being provided a Private Practice Attorney space 16 and a Public Defender Attorney space 17. Following space 16 is an Arraignment space 18*a* and then a Jury selection space 19*a*. Following the space 17 is an Arraignment space 18*b* and a space 20 designated "Can You Post Bond?" From space 20, the path diverges, with a branching path generally designated 21 and being generally referred to as the "No Bond" path. Certain spaces 21*a* thereof are provided with the letters B B, which are the bail bond spaces provided to indicate that a defendant, after initially failing to make bond, is provided with bond, as by relatives, friends or the like. Following the space 20 there is a space 19*b* marked Jury Selection. Following each of the Jury Selection spaces are various spaces, some of which are blank, some of which, such as the spaces 22, are provided with a minus sign, and some of which, such as the spaces 23, are provided with a plus sign. The two branches of the path of spaces, each beginning with the space 16 or 17, combine at the space 24, where the players proceed along the path provided by a suitable number of spaces, some of which are designated 22 and some others of which are designated 23, until there is reached the Verdict space 25.

An alternate branching path 26 extends from the Verdict space 25, representing a jail loop or jail path. In addition, there is a continuation of the main path, to the terminal space 27, marked Home Free.

An important aspect of the present invention apparatus is shown in FIG. 2, which is a representation of exemplary ones of a set of people cards 30. Each of the cards 30 has a back (not shown), all of which are identical. On their faces, the cards 30 are provided with information about various and differing people, such as their name, sex, occupation, age, marital status. Other aspects of the socio-economic characteristics of each individual designated or represented by a people card 30 may be provided, including such things as race, religion, political affiliation, membership in clubs, fraternal organizations, church groups, professional societies, etc. All of these socio-economic characteristics are those which could be obtained by investigation from public sources and records, as is sometimes practiced in connection with the investigation of veniremen designated for a particular criminal trial. For simpler versions of the game, less information may be provided on the people cards 30, while for more sophisticated and complex versions of the game, all of the information heretofore set forth may be provided, and even more.

The purpose of the provision of such detailed information in connection with the veniremen is to simulate the opportunity for exercise of judgemental ability on the part of defense Counsel in the jury selection process, excusing those veniremen who would either be deemed to be somewhat more inclined to pass judgement in favor of the defendant, and perhaps, more importantly, to strike from the jury those veniremen who appear to have beliefs which would tend to cause them to render an adverse verdict upon the defendant. Such information has, at least in recent trials, been utilized, and it is believed that defense Attorneys in the future will increase the use of such information, because of the apparent success which has been achieved through such usage of socio-economic information pertaining to the veniremen.

It will be noted from FIG. 2, that each of the four cards shown has on the upper left hand corner a capital letter, A, B, C, or D. Each is representative of a sub-set, in which are grouped persons of generally similar socio-economic characteristics. Sub-set A are those with the highest socio-economic characteristics, representing, an an example, the upper 50 percent of the population as based on Internal Revenue Service statistics. Sub-set B would be chosen from amongst the upper-middle classes, and may include for example various professional persons, proprietors of small businesses, middle management executives in industry and upper level Governmental Officials. Sub-set C socio-economic characteristics would, for example, include skilled workers and tradesmen, nurses, secretaries, and the like. The socio-economic characteristics of sub-set D would include laborers, the unemployed, etc. These divisions or categories of socio-economic characteristics are generally accepted in Governmental and Academic communities, and are recognized by the general public, consciously or sub-consciously.

FIG. 3 represents the Crime Selector card which includes an index column listing each of the sub-sets, columns headed by the numerals 1–6, and spaces in which various crimes are set forth.

FIG. 4 is the Attorney Selector card, and lists sub-sets C and D, together with the numerals 1–6, and designations of either Private, i.e., Private Practice Attorney, or P. D., i.e., Public Defender.

FIG. 5 is the Bond Posting card, and lists for sub-sets C and D either Yes or No under the numerals 1–6.

FIG. 6 is the Jury Selection Point card. This provides for the awarding of points to, or the removal of points from, each contestant in accordance with his own identity as a member of a particular socio-economic sub-set, and the socio-economic sub-set to which each person on that contestant's jury panel belongs.

FIG. 7 illustrates a plurality of distinct game pieces, each of which is sized to be placed upon and within a space, such as spaces 11, 12, of the path of the game board. These may be of different shapes, styles and/or colors, to distinguish one from the other. FIG. 8 is a common die, although another chance device may be used, such as a spinner.

The game is played by a number of people, such as two to six, the object being to move the game piece from Start to Home Free ahead of the other players, while at the same time observing the rules of the game, and becoming educated in connection with the Criminal Judical Process. The game is started by each player selecting "blind" one of the People cards 30, to thereby establish his specific socio-economic identity for the game, Game pieces of FIG. 7 are provided, one to each player, and the players take turns in rolling the die of FIG. 8, advancing their game pieces the number of spaces indicated by the die, but always stopping on any space marked with the word Stop, such as spaces 13 and 14. When the player reaches the space 13, Police Encounter, the player then rolls the die to determine his crime, this in association with the card of FIG. 3. For example, a person having an identity of sub-set C and rolling a "3" will be charged with the crime of armed robbery. Thereafter, the game piece is moved along the path, until space 14 is reached. Here, those players who are identified in sub-sets A and B will move to Private Practice Attorney space 16, while players with sub-set identities C and D will again roll the die, to determine whether they will have a Private Practice Attorney or a Public Defender Attorney. Those players who have proceeded to Private Practice Attorney space 16 will next stop at the Arraignment space 18*a*, and then again at the Jury Selection space 19*a*.

When a player has reached either Jury Selection space 19*a* or 19*b*, the People cards 30, which have been shuffled, are made available to him, and he selects, blindly and at random, 15 of these cards. These are the veniremen and after he has selected his 15 cards, he is permitted to turn them over, and study the socio-economic characteristics of his 15 veniremen. From these, he is permitted to select those nine which he believes would be most favorable to him, based upon his own identity and the crime with which he is charged. Six of the veniremen are excused, the cards designating them being discarded. At this point, and, indeed, until the player reaches the Verdict space 25, he is not permitted to see the Jury Selection Point card of FIG. 6. Following the jury selection, the player moves along his path, towards the Verdict space 25.

A player who has an identity from sub-set C or D, and who has been assigned a Public Defender Attorney in accordance with the chart of FIG. 4 and the roll of the die, proceeds to space 20, Can you Post Bond?At this point, the player stops, and rolls a die the number on which, together with the Bond Posting card of FIG. 5 provides the answer to whether the player can post bond. If it is thereby determined that the player can post bond, he proceeds through the space marked Yes towards space 19*b*, but if he cannot, he must proceed along the No Bond path 21, and if he lands upon one of the spaces 21*a* marked with the initials BB, for Bail Bond, he may then move his game piece directly to 19*b*, Jury Selection. Otherwise, the player must continue around the path 21, collecting a point if he lands upon space 23, thus simulating advantage from delay of trial. Only if he lands on a space BB will he proceed to select his jury as hereinabove described, and following that, will proceed along his path towards the Verdict space 25.

As the players proceed along the path, they will credit themselves with a point for landing on each of the spaces 23, and will subtract a point for landing upon each of the minus spacers 22.

The play proceeds as indicated, until a player reaches the Verdict spacer 25. At this time, he calculates the point total from the spaces 22 and 23 accumulated during his travel along the path between spaces 19*a* and 19*b* on the one hand, and Verdict space 25 on the other hand, this portion of the path representing the Trial. The points are awarded to simulate such occurrences during Trial as favorable rulings on evidence, failure of the prosecuting Attorney to cross examine effectively, the uncovering of a favorable surprise witness, the ability of his Defense Attorney, etc. The negative or minus spaces 22 are provided to simulate such events as the appearance of a witness making an unfavorable impression upon the Jury, failure of the Defense Attorney to locate a desired witness, etc. When and only when the player has reached Verdict space 25 is he permitted to view the Jury Selection Point card, FIG. 6, and add to and subtract from the points he has accumulated while proceeding along the path on the game board the amount indicated by the Jury Selection Point card.

If the player defendant has a positive point total, he is not guilty, and may move along the path towards the terminal space 27, marked Home Free. If he has a zero or negative point score or tally, he must move along the path 26, beginning with the space marked Guilty. This is the Jail path 26, and the player proceeds around this, for a maximum of three times, but if he reaches and lands upon the space 28, he may transfer his marker to space 14, where he obtains Counsel and begins again. This movement simulates, to some degree, the granting of a new trial. As there are a number of players, more than one player may have to proceed along the Jail path 26, thereby giving an element of contest for those players who have been judged Guilty. A player who fails to land on the space 28, however, after three circuits on the path 26 is able to move directly to space 14.

There has been provided a board game apparatus involving the Criminal Judicial Process, and providing familiarization with and education with regard to such Criminal Judicial Process. Further, the herein disclosed invention apparatus dramatically illustrates to the players thereof the different experiences which defendants with different socio-economic circumstances encounter during the Criminal Judicial Process. Further, the herein set forth apparatus emphasizes with particularity and clarity the importance of Jury Selection in the trial of criminal cases in the diversified society which exists throughout most of the United States. Further, the game apparatus invention herein disclosed introduces in an appropriately simulative manner the effect of chance or fortituous occurences in the conduct of a criminal trial.

It will be obvious to those skilled in the art that various changes may be made without departing from the spirit of the invention and therefore the invention is not limited to what is shown in the drawings and described in the specification but only as indicated in the appended claims.

I claim:

1. A game for imparting an understanding of criminal justice proceedings and the importance of the selection of jurors to a criminal defendant comprising:

a. a game board having an elongate path thereon for movement of game pieces therealong comprising a plurality of spaces, including a start space at one end and a terminal space at the other end, at least some of said spaces including indicia awarding points to or removing points from a player whose game piece lands on one of said spaces, as the game piece is moved in accordance with a chance device, said path further comprising a verdict square and an alternate loop jail path originating at said verdict square to be entered on by a player found guilty, b. a set of people cards each having indicia thereon representing a person having individual socio-economic characteristics from which set the players each randomly select his idenity, and choose the people of his jury, said set of cards having indicia designating a plurality of sub-sets thereof, c. a crime designating card having indicia thereon, i. corresponding to the said indicia designating said sub-sets of said people cards.

ii. a plurality of crime designations for each of said sub-set designations, and iii. each crime for each sub-set designation corresponding to an indicia on a chance device, whereby by operation of the chance device a player having a given identity as a member of a socio-economic sub-set is charged with a particular crime, d. a jury selection point card having indicia thereon corresponding to, i. the said indicia indicating said sub-sets of said people cards, ii. the crime indicia of said crime designating card, and iii. indicia for awarding points to or substracting points from the player in accordance with the characteristics of the jury he has selected as related to his own identity, whereby said points are added to the points accumulated by the player during the movement of his game piece along the game board path, a predetermined point total determining whether the player is guilty and enters the alternate loop jail path or is not guilty and proceeds to the terminal space, e. the game pieces each sized to be placed upon and within a space of said path of said game board, and f. a chance device.

2. The game of claim 1, and further comprising a bond-posting card having indicia thereon corresponding to at least some of the indicia indicating said sub-sets of said people cards and indicia indicating that the player can or cannot post bond.

3. The game of claim 2, said path of said game board having an alternate loop path to be traveled by a player not able to post bond.

4. The game of claim 1, wherein said set of people cards comprises cards having indicia designating at least three sub-sets, each having generally similar socio-economic characteristics.

* * * * *